United States Patent [19]

Tamura et al.

[11] Patent Number: 4,614,475

[45] Date of Patent: Sep. 30, 1986

[54] HYDRAULIC CIRCUIT SYSTEM FOR CIVIL ENGINEERING AND ARCHITECTURAL MACHINERY

[75] Inventors: Seiji Tamura; Toshimichi Ikeda; Toichi Hirata, all of Ibaraki, Japan

[73] Assignee: Hitachi Construction Machinery Company, Inc., Tokyo, Japan

[21] Appl. No.: 737,884

[22] Filed: May 28, 1985

[30] Foreign Application Priority Data

May 2, 1981 [JP] Japan ..... 56-67220
Oct. 13, 1981 [JP] Japan ..... 56-161982

[51] Int. Cl.[4] ..... F02F 3/00

[52] U.S. Cl. ..... 414/694; 37/DIG. 7; 91/530; 180/6.48

[58] Field of Search ..... 91/530, 531; 37/DIG. 7; 414/687, 694; 180/6.48

[56] References Cited

U.S. PATENT DOCUMENTS 3,720,059 3/1973 Schurawski et al. ..... 91/531
4,112,821 9/1978 Bianchetta ..... 91/414
4,210,061 7/1980 Bianchetta ..... 91/531
4,212,165 7/1980 Zirps ..... 60/486

FOREIGN PATENT DOCUMENTS 2203713 8/1973 Fed. Rep. of Germany ..... 91/530
0010801 2/1981 Japan ..... 91/530
0042705 4/1981 Japan ..... 91/530
2009816A 6/1979 United Kingdom ..... 37/DIG. 7
2079377A 1/1982 United Kingdom ..... 91/530

*Primary Examiner*—William R. Cline
*Assistant Examiner*—Randolph A. Smith
*Attorney, Agent, or Firm*—Antonelli, Terry & Wands

[57] ABSTRACT

A hydraulic circuit system for civil engineering and architectural machinery having at least first and second hydraulic pumps, a plurality of actuators driven by hydraulic fluid from said pumps, and a plurality of directional control valves for controlling the direction and flow rate of the hydraulic fluid supplied from the pumps to the actuators. In the directional control valves, a first boom directional control valve and one of right and left travelling directional control valves are connected to the first pump in parallel with each other, a swing directional control valve, an arm directional control valve and a second boom directional control valve are connected to the second pump in parallel with one another, and the other of the right and left travelling directional control valve is connected in tandem to the swing, arm and second boom directional control valves at a location downstream thereof. A connecting line is provided for communication between an inlet port of the one travelling directional control valve and an inlet port of the other travelling directional control valve.

6 Claims, 7 Drawing Figures

HYDRAULIC CIRCUIT SYSTEM FOR CIVIL ENGINEERING AND ARCHITECTURAL MACHINERY

BACKGROUND OF THE INVENTION

This is a continuation of application Ser. No. 374,300 filed May 3, 1982 and now abandoned.

This invention relates to hydraulic circuit systems for civil engineering and architectural machinery, and more particularly to a hydraulic circuit system for civil engineering and architectural machinery, equipped with a plurality of working elements, such as hydraulic shovels.

Generally, a machine for doing a civil engineering or architectural work, for example a hydraulic shovel, is equipped with a plurality of working elements including a swing member, left and right travel members, a boom, an arm and a bucket which are driven by actuators of a hydraulic circuit system including a swing motor, right and left travelling motors, a boom cylinder, an arm cylinder and a bucket cylinder, those actuators being controlled by directional control valves.

In the aforesaid hydraulic circuit system, it has hitherto been usual practice to connect the bucket directional control valve, the boom directional control valve and the right travelling directional control valve to a first hydraulic pump in parallel with one another so that the first hydraulic pump, the directional control valves, and the bucket cylinder, the boom cylinder and the right travelling motor will constitute an independent hydraulic circuit, and connect the arm directional control valve, the swing directional control valve and the left travelling directional control valve to a second hydraulic pump in parallel with one another so that the second hydraulic pump, the directional control valves, and the arm cylinder, the swing motor and the left travelling motor constitute another independent hydraulic circuit. The hydraulic circuit system of the aforesaid construction would have the following disadvantages:

(a) When it is desired to actuate the arm during travel, hydraulic fluid would tend to flow to the arm directional control valve with a lower load rather than to the left travelling directional control valve since these two valves are connected in parallel with each other. This would result in the left track being actuated with a time lag behind actuation of the right track, making it impossible for the vehicle body to move straight ahead. Also, a combined operation of arm and travelling has hitherto been performed when it is desired to get the vehicle body out of the wet ground, but, if the left and right tracks become idle, then a force of sufficiently high magnitude could not be obtained for the arm.

(b) When it is desired to move the swing member during travel, hydraulic fluid would tend to flow to the swing directional control valve rather than to the left travelling directional control valve since these two valves are connected in parallel with each other. This would result in the left track being actuated with a time lag behind actuation of the right track, thereby making it impossible for the vehicle body to move straightforwardly. Also, when the load applied to the travel motors is low, hydraulic pressure required for effecting swinging would be lacking, which makes it difficult to conduct the swing operation.

(c) When it is desired to actuate the bucket during travel, hydraulic fluid would tend to flow to the bucket directional control valve with a lower load rather than to the right travelling directional control valve since these valves are connected in parallel with each other. As a result, the left track would be actuated with a time lag behind actuation of the left track, making it impossible for the vehicle body to move straightforwardly.

(d) When it is desired to actuate the boom during travel, hydraulic fluid would not be supplied to the boom directional control valve in a volume large enough to raise the boom because the boom directional control valve and the right travelling directional control valve are connected in parallel with each other. Thus, a situation would arise in which the boom is unraisable.

SUMMARY OF THE INVENTION

This invention has been developed for the purpose of obviating the aforesaid disadvantages of the prior art. Accordingly, the invention has as its object the provision of a hydraulic circuit system for civil engineering and architectural machinery capable of exerting equal drive forces on the left and right tracks of a travelling device when various working elements are actuated during travel.

According to the invention, there is provided a hydrualic circuit system for civil engineering and architectural machinery comprising: at least first and second hydraulic pumps; a plurality of actuators driven by hydraulic fluid from said pumps; and a plurality of directional control valves for controlling the direction and flow rate of the hydraulic fluid supplied from said pumps to said actuators; wherein said directional control valves comprise a first boom directional control valve and one of right and left travelling directional control valves connected to said first pump in parallel with each other, a swing directional control valve, an arm directional control valve and a second boom directional control valve connected to said second pump in parallel with one another, and the other of said right and left travelling directional control valve connected in tandem to said swing, arm and second boom directional control valves at a location downstream thereof, and a connecting line is provided for communication between an inlet port of said one travelling directional control valve and an inlet port of the other travelling directional control valve.

Preferably, an on-off valve may be mounted in said connecting line. Preferably, pressure control means is provided for communication between the inlet port of the other travelling directional control valve and the second hydraulic pump, which may comprise a restrictor or a relief valve.

DESCRIPTION OF THE PREFERRED EMBODIMENTS

Figure 1:
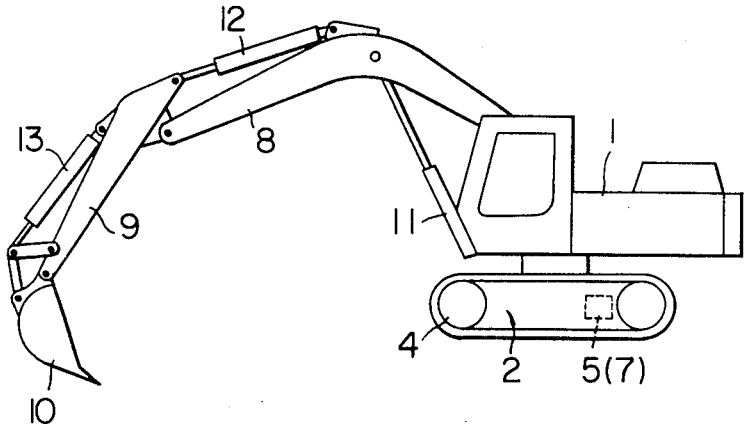
FIG. 1 is a side view of a hydraulic shovel in its entirety which is one example of civil engineering and architectural machinery to which the hydraulic circuit system according to the invention is applied.
Figure 2:
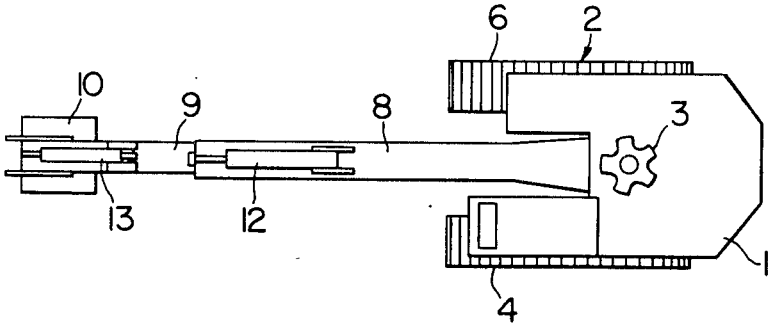
FIG. 2 is a plan view of the hydraulic shovel shown in FIG. 1.

Referring to FIGS. 1 and 2, a hydraulic shovel which is shown as one example of civil engineering and architectural machinery to which the hydraulic circuit system according to the invention is applied comprises a swing member 1 located on an upper portion of a travelling device 2 and rotated by a swing motor 3. The travelling device 2 comprises a left track 4 driven by a left travel motor 5 and a right track 6 driven by a right travel motor 7. The hydraulic shovel further comprises a boom 8 driven by a boom cylinder 11, an arm 9 driven by an arm cylinder 12 and a bucket 10 driven by a bucket cylinder 13.

One embodiment of the hydraulic circuit system in conformity with the invention as incorporated in the hydraulic shovel of the aforesaid construction will be described by referring to FIG. 3.

Figure 3:
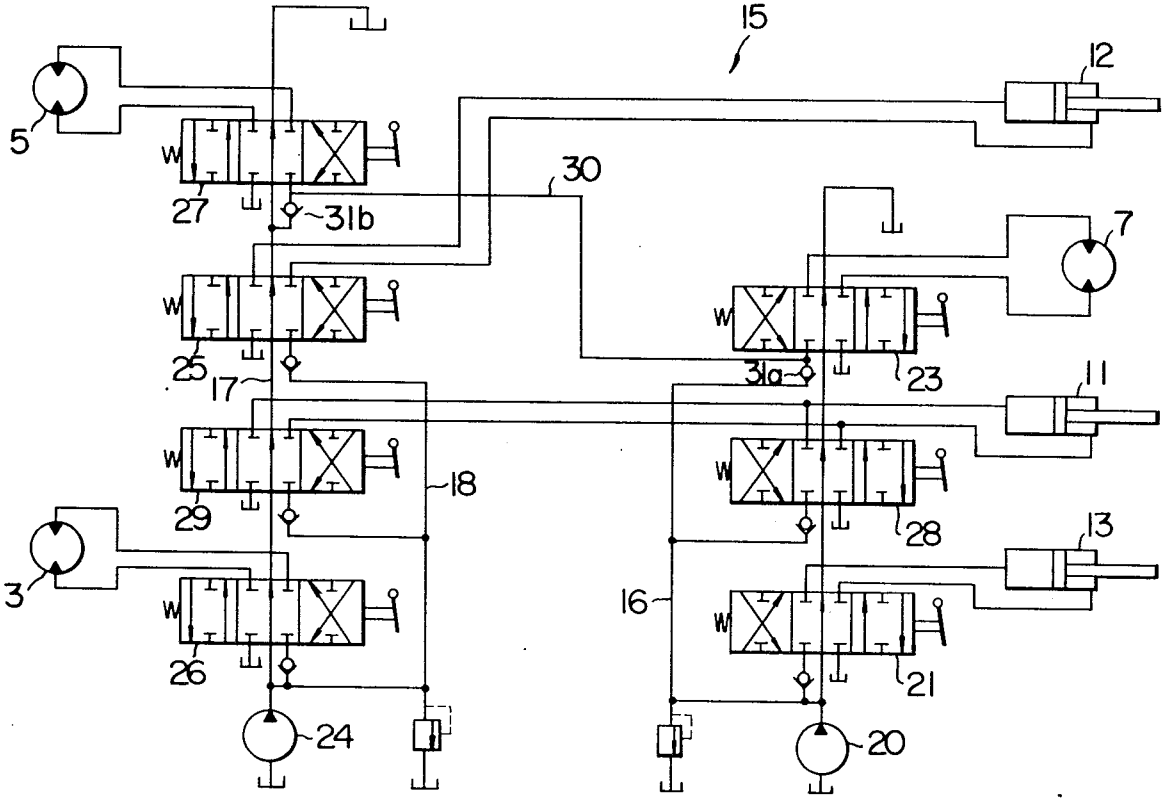
FIG. 3 is a circuit diagram of one embodiment of the hydraulic circuit system for civil engineering and architectural machinery in conformity with the invention.

The hydraulic circuit system shown in FIG. 3 is generally designated by reference numeral 15 and comprises a first hydraulic pump 20 and a second hydraulic pump 24. In the hydraulic circuit system 15, a directional control valve 21 for actuating the bucket cylinder 13, a first directional control valve 28 for actuating the boom cylinder 11 and a directional control valve 23 for actuating the right travel motor 7 are connected to the first pump 20 in parallel with one another, and a directional control valve 26 for actuating the swing motor 3, a second directional control valve 29 for actuating the boom cylinder 11 and a directional control valve 25 for actuating the arm cylinder 12 are connected to the second pump 24 in parallel with one another. A directional control valve 27 for actuating the left travel motor 5 is connected in tandem to the swing, second boom and arm directional control valves 26, 29 and 25 at a location downstream thereof. An inlet port of the right travelling directional control valve 23 is in communication with an inlet port of the left travelling directional control valve 27 through a connecting line 30. 31*a* and 31*b* are load checks for preventing backflow of fluid.

Operation of the hydraulic circuit system 15 of the aforesaid contruction will be described.

When the travelling directional control valves 23 and 27 are actuated singly, operation is performed in the same manner as normal operation. More specifically, the hydraulic fluid discharged from the first hydraulic pump 20 flows from a parallel circuit 16 through the load check 31*a* to the right travelling directional control valve 23 to actuate the right travel motor 7. The hydraulic fluid discharged from the second hydraulic pump 24 flows from a center bypass circuit 17 through the load check 31*b* to the left travelling directional control valve 27 to actuate the left travel motor 5.

When the arm directional control valve 25 is actuated during travel with the travelling directional control valves 23 and 27, the hydraulic fluid from the first hydraulic pump 20 is fed through the right travelling directional control valve 23 to the right travel motor 7 to actuate same. Meanwhile, the hydraulic fluid from the second hydraulic pump 24 is fed through a parallel circuit 18 and the arm directional control valve 25 to the arm cylinder 12 to actuate same. Since the left travelling directional control valve 27 is connected in tandem, hydraulic fluid from the second pump 24 is not supplied to the left travel motor 5, but the hydraulic fluid from the first pump 20 is supplied through the connecting line 30 to the left travelling directional control valve 27, so that the left travel motor 5 is actuated without being shut down. Hydraulic fluid feeding circuits for the left travel motor 5 and right travel motor 7 are connected in parallel with each other through the connecting line 30, and thus it might appear that the hydraulic fluid would not be supplied in equal volumes to the two motors 5 and 7. However, the vehicle body is capable of moving straight-forwardly by the essential straight-forwardness of the movement of crawlers which constitute the travelling device. In this way, the right travel motor 5 and left travel motor 7 receive a supply of hydraulic fluid from the first pump 20, and the arm cylinder 12 receives a supply of hydraulic fluid from the second pump 24. Thus, the vehicle body can move straight-forwardly without any trouble and a force of sufficiently high magnitude can be secured for the arm cylinder when an attempt is made to move out of the wet ground by performing a combined operation of arm movement and travelling.

When the swing directional control valve 26 is actuated during travel with the travelling directional control valves 23 and 27 being actuated, the hydraulic fluid discharged from the second pump 24 is used for moving the swing member by feeding through the swing directional control valve 26 while flow-from pump 24 to control valve 27 and left travel motor 5 is cut off. On the other hand, hydraulic fluid discharged from the first pump 20 is fed through the connecting line 30 to the left travel motor 5 as well as to the right travel motor 7. Thus, the vehicle body can be moved straight ahead.

When the bucket directional control valve 21 is actuated during travel with the travelling directional control valves 23 and 27 being actuated, the hydraulic fluid discharged from the first pump 20 is fed through the bucket directional control valve 21 and the right travelling directional control valve 23 to the bucket cylinder 13 and the right travel motor 7, respectively. Thus, the hydraulic fluid fed from the first pump 20 to the right travel motor 5 diminishes but the hydraulic fluid discharged from the second pump 24 which supplies hydraulic fluid to the left travel motor 5 is fed through the connecting line 30 to the right travel motor 7 in sufficient quantity. Thus, the vehicle body can be moved straight ahead.

When the boom directional control valves 28 and 29 are actuated during travel with the travelling directional control valves 23 and 27 being actuated, the hydraulic fluid from the second pump 24 is supplied to the boom cylinder 11 through the second boom directional control valve 29, and the hydraulic fluid from the first pump 20 is supplied to the right travel motor 7 and the left travel motor 5 through the travelling directional control valves 23 and 27, respectively. Thus, the boom can be positively raised although the working pressure for actuating the travel motors might be slighlty reduced.

Figure 4:
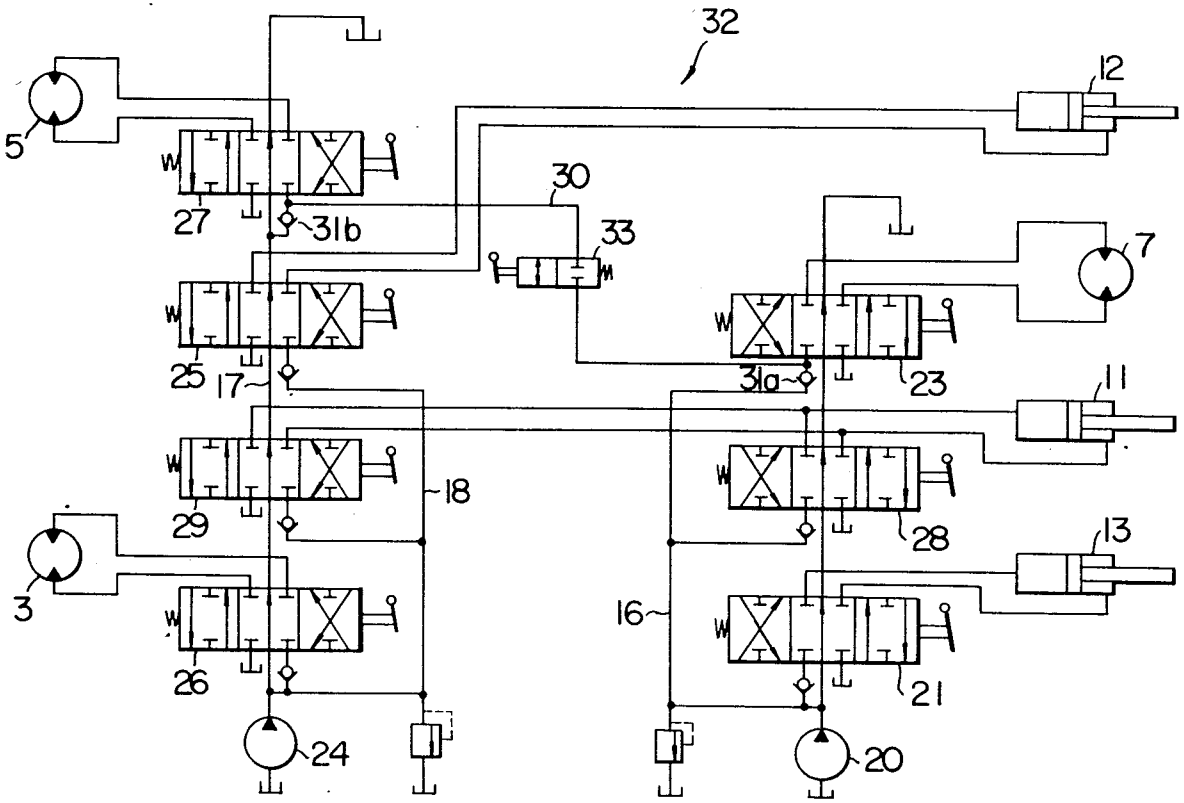
FIG. 4 is a circuit diagram of a modification to the hydraulic circuit system shown in FIG. 3.

FIG. 4 shows a modification to the embodiment shown in FIG. 3. In FIG. 4, parts similar to those shown in FIG. 3 are designated by like reference characters.

In FIG. 4, a hydraulic circuit system generally designated by reference numeral 32 is essentially similar in construction to the embodiment shown in FIG. 3, except that an on-off valve 33 is mounted in the connecting line 30 communicating the inlet port of the right travelling directional control valve 23 to the inlet port of the left travelling directional control valve 27. The on-off valve 33 may be manually manipulated by an operator or by depression of the pedal by an operator.

In the hydraulic circuit system 32 of the aforesaid construction, it is possible to individually actuate the left travel motor 5 and the right travel motor 7 independently of each other by suitably manipulating the on-off valve 33. This enables the vehicle body to move straight ahead when only the travel motors are actuated, particularly travelling on a slope.

A second embodiment of the hydraulic circuit system in conformity with the invention will be described by referring to FIG. 5, in which parts similar to those shown in FIG. 3 are designated by like reference characters.

Figure 5:
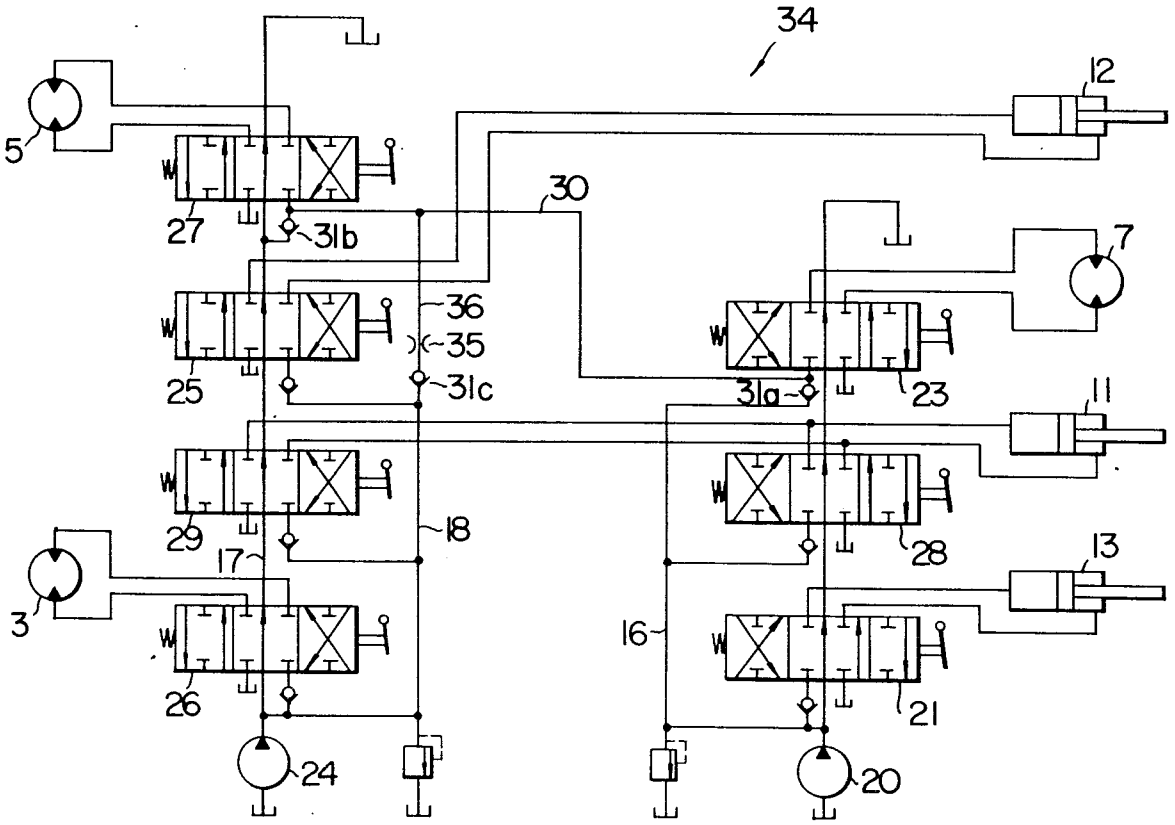
FIG. 5 is a circuit diagram of another embodiment of the hydraulic circuit system for civil engineering and architectural machinery in conformity with the invention.
Figure 7:
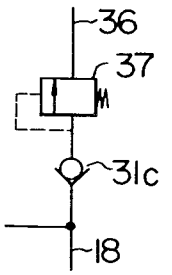
FIG. 7 is a fragmentary circuit diagram of the hydraulic circuit system shown in FIG. 5 in which a relief valve is used as pressure control means.

A hydraulic circuit system generally designated by reference numeral 34 in FIG. 5 is essentially similar in construction to the embodiment shown in FIG. 3, except that the inlet port of the left travelling directional control valve 27 and the second pump 24 is connected through a bypass circuit 36 mounting therein a load check 31*c* and pressure control means 35, such as a restrictor.

Operation of the hydraulic circuit system 34 of the aforesaid construction will be described. When the arm directional control valve 25 is actuated during travel with the travelling directional control valves 23 and 27 being actuated, the hydraulic fluid discharged from the first pump 20 is fed through the right travelling directional control valve 23 to the right travel motor 7 to actuate same. Meanwhile, the hydraulic fluid from the second pump 24 is fed through the arm directional control valve 25 to the arm cylinder 12. At the same time, a portion of the hydraulic fluid from the second pump 24 is fed to the left travelling directional control valve 27 through the bypass circuit 36. Since the hyraulic fluid from the second pump 24 flows in part to the arm cylinder 12 and the rest to the left travelling directional control valve 27, the hydraulic fluid fed to the left travelling valve 27 might be not enough in quantity to satisfactorily drive the left travel motor 5, but the hydraulic fluid discharged from the first pump 20 is also supplied in part to the left travelling valve 27 through the connecting line 30. Thus, the left travel motor 5 can be driven in the same manner as the right travel motor 7. In this way, the hydraulic fluid from the second pump 24 is supplied to the arm cylinder 12 which takes priority over the left travel motor 5, and the hydraulic fluid from the first pump 20 and the rest of the hydraulic fluid from the second pump 24 are fed to the left travel motor 5 and the right travel motor 7. Thus, the vehicle body can be moved straight ahead without wavering and a force of sufficiently high magnitude can be secured for the arm cylinder when an attempt is made to move out of the wet ground by performing a combined operation of arm and travelling.

When the swing directional control valve 26 is actuated during travel with the travelling directional control valves 23 and 27 being actuated, the hydraulic fluid from the second pump 24 is supplied through the swing directional control valve 26 to the swing motor 3 by taking priority over the left travel motor 5. This might cause the hydraulic fluid supplied to the left travel motor 5 to become deficient. However, the hydraulic fluid discharged from the first pump 20 is fed through the connecting line 30 to the travel motor 5 as well as the right travel motor 7, and therefore the vehicle body can be moved straight ahead.

The operation for actuating the bucket directional control valve 21 during travel with the travelling directional control valves 23 and 27 are being actuated is similar to the operation described by referring to the embodiment shown in FIG. 3.

When the boom directional control valves 28 and 29 are actuated during travel with the travelling directional control valves 23 and 27 being actuated, the hydraulic fluid from the second pump 24 largely flows through the second boom directional control valve 29 to the boom cylinder 11 since the presence of the restrictor 35 restricts its flow to the left travelling directional control valve 27, and the hydraulic fluid from the first pump 20 is supplied through the travelling directional control valves 23 and 27 to the right travel motor 7 and left travel motor 5. Thus, the boom can be positively raised even if the working pressure for actuating the travel motors drops.

In the embodiment of the aforesaid construction shown in FIG. 5, the inlet port of the left travelling directional control valve 27 is connected to the second pump 24 through the pressure control means 35. By virtue of this feature, when a combined operation of at least one of the swing motor 3, boom cylinder 11 and arm cylinder 12 actuated by the valves 26, 29 and 25, respectively, which are connected in parallel with one another and the left and right travel motors 5 and 7 is performed, it is possible to supply the remainder of the hydraulic fluid from the second pump to the left and right travel motors 5 and 7 after the majority thereof is supplied to the swing motor, boom cylinder or arm cylinder. This enables the hydraulic fluid from the second pump 24 to be effectively utilized and at the same time allows sudden deceleration of the left and right motors to be avoided.

In the foregoing description, the restrictor is used as the pressure control means 35 mounted in the circuit 36. However, the invention is not limited to this specific form of pressure control means and a relief valve may be used in place of the restrictor.

Figure 6:
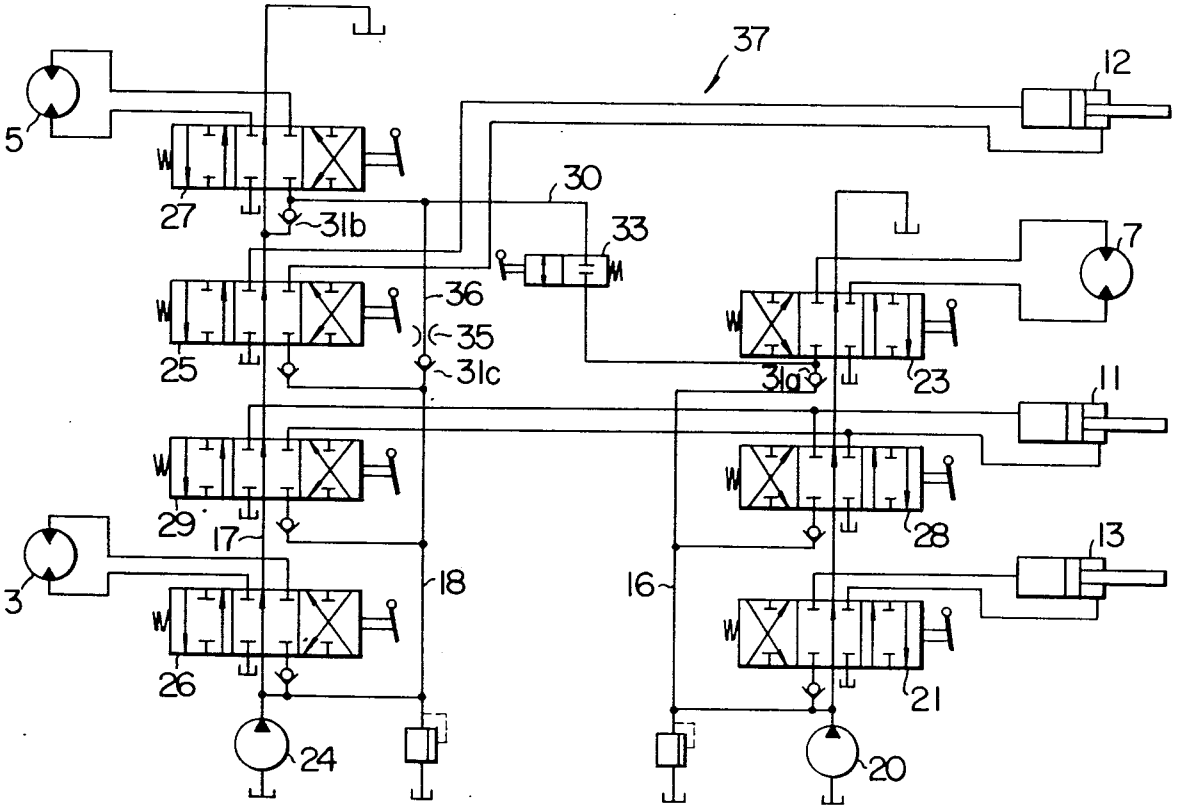
FIG. 6 is a circuit diagram of a modification to the hydraulic circuit system shown in FIG. 5.

FIG. 6 shows a modification to the embodiment shown in FIG. 5 which represents a modification similar to the modification shown in FIG. 4 to the embodiment shown in FIG. 3. In FIG. 6, parts similar to those shown in FIGS. 3-5 are designated by like reference characters. A hydraulic circuit system generally designated by reference numeral 37 includes the on-off valve 33 mounted in the connecting line 30 communicating the inlet ports of the right and left travelling directional control valves 23 and 27 to each other. By this arrangement, it is possible, as aforesaid, to individually actuate the left travel motor 5 and the right travel motor 7 independently of each other by suitably manipulating the on-off valve 33. This enables the vehicle body to move straight ahead without wavering when only the travel motors are actuated, particularly in travelling on a slope.

In the embodiments shown in FIGS. 3-6, the bucket directional control valve 21, first boom directional control valve 28 and right travelling directional control valve 23 are connected to the first pump 20 in parallel with one another. The invention is not limited to this specific arrangement of the valves 21, 28 and 23 and the bucket directional control valve 21 alone may be connected in tandem without reducing the effects achieved by the invention.

From the foregoing description, it will be appreciated that according to the invention, the hydraulic circuit system for civil engineering and architectural machinery is constructed such that the first boom directional control valve and one of right and left travelling directional control valves are connected to the first hydraulic pump in parallel with each other, the swing directional control valve, the arm directional control valve and the second boom directional control valve are connected to the second hydraulic pump in parallel with one another and the other of the right and left travelling directional control valve is connected in tandem to the swing, arm and second boom directional control valves at a location downstream thereof, while the inlet ports of the right and left travelling directional control valves are in communication with each other through a connecting line, and therefore, when it is desired to operate various actuators during travel, it is possible to operate the travel motors substantially independently of the other actuators and supply hydraulic fluid from the first hydraulic pump or the second hydraulic pump in equal volumes to the left and right travel motors through the connecting line thereby to allow forces of the same magnitude to be exerted on the left and right tracks constituting a travelling device. Thus, the vehicle body can move straight ahead while allowing each actuator to operate satisfactorily.

What is claimed is:

1. A hydraulic circuit system for civil engineering and architectural machinery provided with a base frame means, left and right traveling members mounted to the base frame structure for traveling thereof, a swing mounted to the base frame means for horizontal swinging movement, a boom mounted to the swing for vertical pivotal movement, an arm connected to a forward end of the boom for vertical pivotal movement, and a bucket connected to a forward end of the boom for vertical pivotal movement, said hydraulic circuit system, comprising:

at least first and second hydraulic pumps;

a plurality of hydraulic actuator means including left and right traveling actuators, a swing actuator, a boom actuator, an arm actuator, and a bucket actuator respectively connected to said right and left traveling devices, swing, boom, arm and bucket for driving the same;

a first valve group including a first boom directional control valve connected to said boom actuator for controlling a flow of hydraulic fluid thereto and one of a right traveling directional control valve and a left traveling directional control valve connected to the corresponding one of the right and left traveling actuators for controlling a flow of hydraulic fluid thereto, which are connected to said first pump in parallel with each other;

a second valve group including a swing directional control valve connected to said swing actuator for controlling the flow of hydraulic fluid thereto, a second boom directional control valve connected to said boom actuator for controlling a flow of hydraulic fluid thereto, an arm directional control valve connected to said arm actuator for controlling a hydraulic fluid thereto, and the other of said right and left traveling directional control valves connected to the other of the right and left traveling actuators for controlling a flow of hydraulic fluid thereto, said swing, second boom and arm valves being connected in parallel with each other, and said other traveling directional control valve being connected in tandem relative to said parallel-connected swing, second boom and arm valves at a location downstream thereof so as to be operable to receive a flow of hydraulic fluid from second pump via said swing, second boom and arm valves only when they are in an inactive bypass condition; and a connecting line directly communicating an inlet port of said one traveling valve and an inlet port of the said other traveling valve with each other to permit hydraulic fluid flow between said inlet ports in either direction through said connecting line so as to comprise a means by which the hydraulic fluid flow is discharged from said first and second pumps and supplied to said right and left traveling valves with said hydraulic fluid flow being to right and left travel motors of the respective hydraulic actuators of the traveling members when loads applied to said motors are substantially equal to each other.

2. A hydraulic circuit system as claimed in claim 1, wherein said connecting line is connected with the inlet ports of said right and left traveling valves at locations downstream of load check valves therefor for preventing backflow of hydraulic fluid from the respective traveling valves.

3. A hydraulic circuit system as claimed in claim 1, wherein an on-off valve is mounted in said connecting line.

4. A hydraulic circuit system as claimed in claim 1, wherein pressure control means is provided for communication between said inlet port of the other travelling directional control valve and said second pump.

5. A hydraulic circuit system as claimed in claim 4, wherein said pressure control means comprises a restrictor.

6. A hydraulic circuit system as claimed in claim 4, wherein said pressure control means comprises a relief valve.

* * * * *